US008185007B2

(12) United States Patent
Tsukamura et al.

(10) Patent No.: US 8,185,007 B2
(45) Date of Patent: May 22, 2012

(54) TRANSFER DEVICE, IMAGE FORMING APPARATUS AND CONTROL METHOD OF TRANSFER DEVICE

(75) Inventors: Shinichi Tsukamura, Uenohara (JP); Nobuhiko Okano, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 338 days.

(21) Appl. No.: 12/469,549

(22) Filed: May 20, 2009

(65) Prior Publication Data

US 2009/0290889 A1 Nov. 26, 2009

(30) Foreign Application Priority Data

May 23, 2008 (JP) ..... 2008-135427

(51) Int. Cl.
*G03G 15/16* (2006.01)

(52) U.S. Cl. ..... 399/66; 399/45; 399/297

(58) Field of Classification Search ..... 399/45, 399/66, 297

See application file for complete search history.

(56) References Cited

U.S. PATENT DOCUMENTS 5,410,393 A 4/1995 Watanabe
5,832,335 A 11/1998 Fukasawa
5,857,132 A * 1/1999 Mizuishi et al. ..... 399/66
6,205,299 B1 3/2001 Kusaka et al.
6,731,890 B1 5/2004 Rakov et al.

FOREIGN PATENT DOCUMENTS

JP 2-39181 A 2/1990
JP 10-240032 A 9/1998
JP 2004-93685 A 3/2004
JP 2006-220974 A 8/2006

OTHER PUBLICATIONS

Japanese Office Action , Trial for Japanese Patent Application No. 2008-135427 mailing date of Mar. 22, 2011 with English Translation.
Japanese Office Action for Patent Application No. JP 2008-135427 mailed Apr. 20, 2010 with English translation.
European Search Report for Application No. 09160268.0-2209 dated Sep. 14, 2009.

* cited by examiner

*Primary Examiner* — Ryan Walsh
(74) *Attorney, Agent, or Firm* — Cantor Colburn LLP

(57) ABSTRACT

A transfer device includes: a transfer section for transferring a toner image on an image carrier onto a sheet passing through a nip portion which is formed between the transfer section and the image carrier; an application section for applying a voltage to the transfer section; and a control section for controlling the application section, wherein the control section controls the application section to apply a voltage having an opposite polarity to a transfer polarity to the transfer section since a leading edge of the sheet in a conveyance direction advances into the nip portion until a predetermined non image area of the sheet has passed through the nip portion, and then switch to apply a voltage having the transfer polarity from the voltage having the opposite polarity to the transfer section while a non image area of the sheet passes through the nip portion.

18 Claims, 5 Drawing Sheets

TRANSFER DEVICE, IMAGE FORMING APPARATUS AND CONTROL METHOD OF TRANSFER DEVICE

RELATED APPLICATION

This application is based on Japanese Patent Application NO. 2008-135427 filed on May 23, 2008 in Japanese Patent Office, the entire content of which is hereby incorporated by reference.

FIELD OF THE INVENTION

The present invention relates to a transfer device which transfers a toner image on an image carrying member onto a sheet, and an image forming apparatus which has the transfer device.

BACKGROUND OF THE INVENTION

An image forming apparatus of an electro photography system has a transfer device which transfers a toner image formed on the image carrier (for example, a photoreceptor, an intermediate transfer member, etc.) onto a sheet. There are some which have adopted a contact transfer system which contacts a transfer roller or a transfer belt onto a sheet as a transfer device for transferring a toner image onto the sheet.

FIG. 6 is an explanatory view showing a transfer area of a contact transfer system. The contact transfer system shown in FIG. 6 presses a transfer belt B to a photoreceptor K with a transfer roller T to form a transfer nip portion N between the photoreceptor K and the transfer belt B. In case when transferring a toner image formed on the photoreceptor K onto a sheet S which advances into the transfer nip portion N, voltage (transfer voltage) having a polarity which is opposite to the polarity of toner is applied to a transfer roller T to move the toner onto the sheet S from the photoreceptor K. For example, in case where the toner has a minus polarity, transfer voltage of a plus polarity is applied to the transfer roller T.

By the way, as shown in FIG. 6, in cases where the sheet S which has burrs X at the edge of the conveyance direction is advanced into the transfer nip portion N and the transfer voltage is applied to the transfer roller T, the direction of an electric field points toward the photoreceptor K from the transfer roller T. Therefore, electric discharge occurs in the opening which is formed at the leading edge of the sheet between the transfer belt B and the sheet S, and the edge of the sheet S in the conveyance direction is charged with the same polarity of the transfer voltage. As a result, the edge of the sheet S sticks to the photoreceptor K charged with an opposite polarity of the transfer voltage, and poor separation that the sheet S winds around the photoreceptor K occurs.

Then, technology for preventing poor separation of a sheet even in case where there is a burr at the edge of the sheet in the conveyance direction has been proposed.

The technology disclosed in Unexamined Japanese Patent Application Publication No. H10-240032 is a technology for providing the portion to which the transfer voltage is not applied in a predetermined area starting from the leading edge of the sheet in the conveyance direction. According to this technology, it is possible to prevent poor separation, because discharges do not occur even though there is a burr on the leading edge of the sheet in the conveyance direction and the sheet S does not wind around the image carrier (Unexamined Japanese Patent Application Publication No. H10-240032 discloses a case in which the image carrier is an intermediate transfer drum).

According to the technology disclosed in Unexamined Japanese Patent Application Publication No. H10-240032, the applied voltage in the predetermined area of the leading edge of a sheet in the conveyance direction is 0V (or the voltage value is close to 0V), and although the sheet has a burr, discharge seldom occurs. However, the polarity of the leading edge of the sheet in the conveyance direction does not become the polarity which repels with an image carrying member. Therefore, as shown in FIG. 6, when there is an opening between the transfer belt B and the leading edge of sheet S, the leading edge of sheet S will be hard to be adsorbed by the transfer belt B but the leading edge of the sheet S will be easily stacked to the photoreceptor K. Therefore, according to the technology disclosed in Unexamined Japanese Patent Application Publication No. H10-240032, the poor separation cannot be fully prevented.

An object of the present invention is to provide a transfer device and an image forming apparatus which are capable of preventing poor separation and fully secure the density of a toner image to be transferred onto a sheet.

SUMMARY OF THE INVENTION

One aspect of the present invention is to provide a transfer device comprising: a transfer section for transferring a toner image on an image carrier onto a sheet passing through a nip portion which is formed between the transfer section and the image carrier; an application section for applying a voltage to the transfer section; and a control section for controlling the application section, wherein the control section controls the application section to apply a voltage having an opposite polarity to a transfer polarity to the transfer section since a leading edge of the sheet in a conveyance direction advances into the nip portion until a predetermined non image area of the sheet has passed through the nip portion, and then switch to apply a voltage having the transfer polarity from the voltage having the opposite polarity to the transfer section while a non image area of the sheet passes through the nip portion.

Another aspect of the present invention is to provide a control method of a transfer device which comprises a transfer section for transferring a toner image on an image carrier onto a sheet passing through a nip portion which is formed between the transfer section and the image carrier and an application section for applying voltage to the transfer section, the control method comprising: controlling the application section to apply a voltage having an opposite polarity to a transfer polarity to the transfer section since a leading edge of the sheet in a conveyance direction advances into the nip portion until a predetermined non image area of the sheet has passed through the nip portion; and then controlling the application section to switch to apply a voltage having the transfer polarity from the voltage having the opposite polarity while a non image area of the sheet passes through the nip portion.

BRIEF DESCRIPTION OF THE DRAWING

These and other objects, advantages and features of the invention will become apparent from the following description thereof taken in conjunction with the accompanying drawings in which.

DESCRIPTION OF THE PREFERRED EMBODIMENT

[The Outline of an Image Forming Apparatus]

Figure 1:
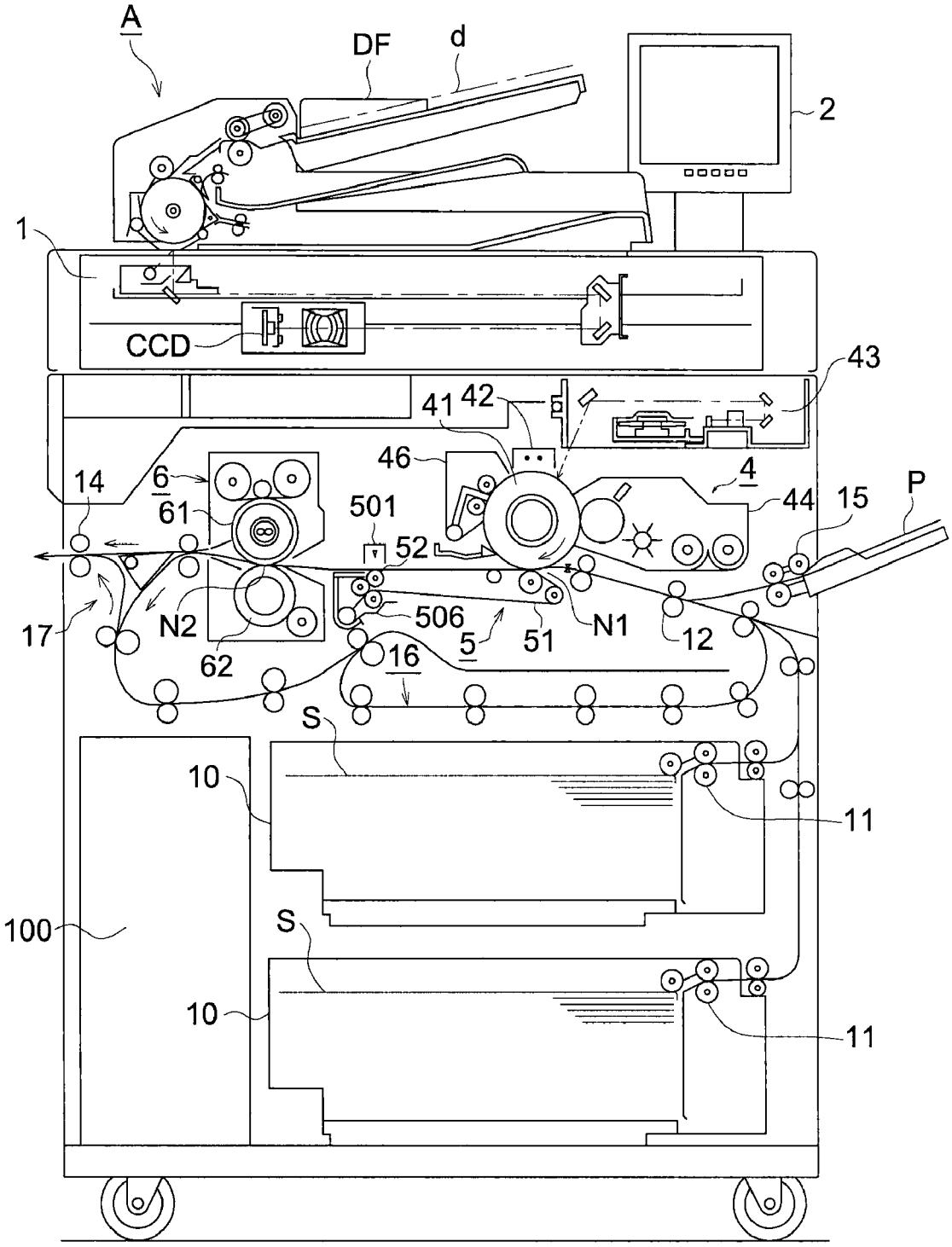
FIG. 1 illustrates a central sectional view of an image forming apparatus.

FIG. 1 illustrates a central sectional view of an image forming apparatus. The Image forming apparatus shown in FIG. 1 comprises an automatic document feed apparatus DF, an image reading section 1, an operation display section 2, an image forming section 4, a transfer section 5, a fixing section 6 and a paper sheet conveyance system.

The image forming section 4 comprises a photoreceptor (an image carrying member) 41, a charging section 42, an exposure section 43, a development device (a developing device) 44, and a photoreceptor cleaning section 46. The paper sheet conveyance system comprises a paper sheet feeding cassette 10, a first feed section 11, second feed section 12, a paper sheet ejection section 14, a manual feeding section 15, re-feed section 16 and a reversal paper sheet ejection section 17.

A document "d" placed on the document table of the automatic document feed apparatus DF is conveyed by a paper sheet feeding device. The images of one side of the document "d" or both sides are read by the optical system of the image reading section 1, and they are read by an image sensor CCD. In an image processing section (not shown), analog processing, an A/D conversion, a shading compensation and image-compression processing are performed with the analog signal into which the image sensor CCD has converted the optical image signal. After that, the image signal is transmitted to the exposure section 43.

In the image forming section 4, against the photoreceptor 41, an electric charge (it will be a negative charge in the case of an embodiment of the present invention) is added by the charging section 42, and an electrostatic latent image is formed by the laser beam irradiated from the exposure section 43. Then, an electrostatic latent image is developed by the development device 44, and it becomes a toner image (it will be a negative electric charge in the case of an embodiment of the present invention).

Subsequently, a sheet S accommodated in the paper sheet feeding cassette 10 is conveyed from the first feed section 11, and the synchronization with the toner image is taken with a registration roller. The traveling position of the leading edge of the sheet S is detected by a sheet detection sensor, and the information is transmitted to the control section 100. The entry timing to the transfer nip portion N1 formed between the transfer section 5 and the photoreceptor 41 is calculated.

Then, the toner image is transferred onto the sheet S in the transfer nip portion N1, and the sheet S electro-statically absorbed onto the transfer belt 51 is conveyed. While an anti-static is performed by a corona discharge from a separation anti-static pole 501, curvature separation is performed with a separation roller 52, and the sheet S on transfer belt 51 is conveyed to the fixing section (a fixing device) 6.

The fixing nip portion N2 formed by the fixing roller 61 and the pressing roller 62 in the fixing section 6 fixes the toner image onto a sheet. After the fixing operation, the paper sheet ejection section 14 ejects the sheet S out of the apparatus.

The toner of transfer residue on the photoreceptor 41 is removed by the photoreceptor cleaning section 46. The untransformed toner on the transfer belt 51 is removed by a belt cleaning section 506.

In the case of double-sided printing, the sheet S onto which image formation has been performed onto the first side is sent into a re-feed section 16, is switch backed and reversed. After image formation onto the second side in the image forming section 4, the sheet S is ejected by the paper sheet ejection section 14 out of the apparatus. After the sheet S branched from the usual sheet ejection passage in reversal sheet ejection is switched back and rear surface inversion is performed in a reversal paper sheet ejection section 17, the sheet S is ejected out of the apparatus by the paper sheet ejection section 14.

The image forming apparatus A of an embodiment of the present invention is to form a monochrome image on sheet S. However, the image forming apparatus A may be an image forming apparatus having a configuration which transfers a color image formed on an intermediate transfer member onto the sheet S.

[Outline of Transfer Section]

Figure 2:
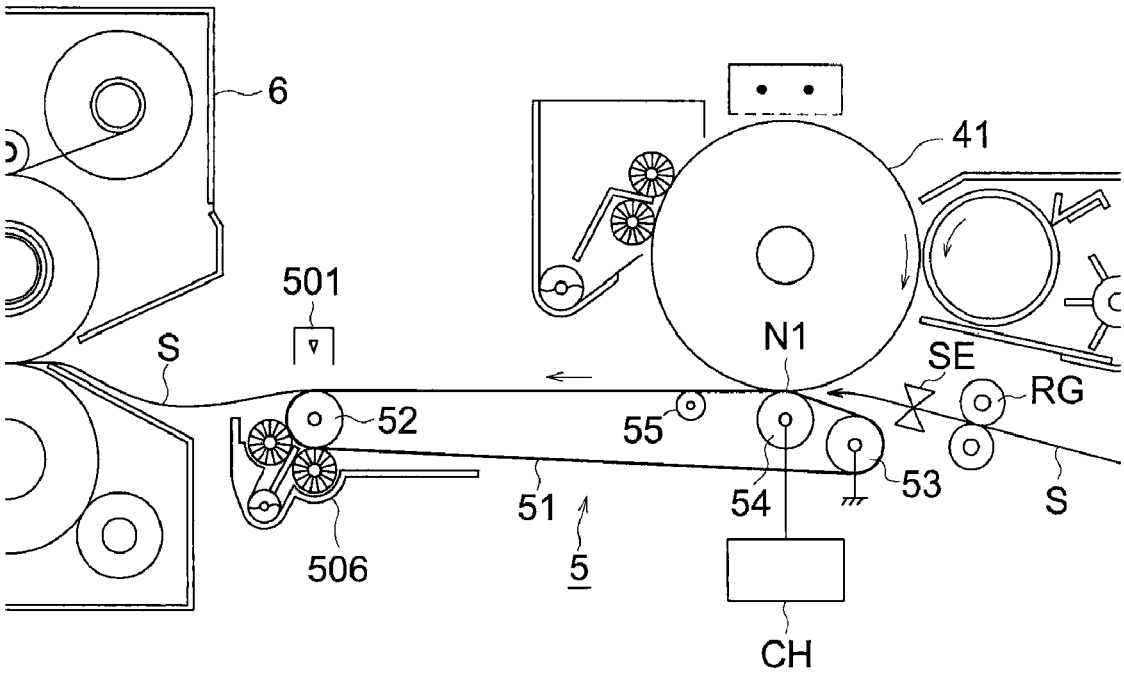
FIG. 2 illustrates an expanded sectional view of a transfer section circumference.

FIG. 2 is an expanded sectional view of the transfer section 5 circumference.

As for transfer section 5, a transfer belt 51 is stretched with a separation roller 52 structured by stainless steel (SUS), driven rollers 53 and 55 structured by an aluminum alloy and transfer roller 54 structured by foaming urethane. The separation roller 52 bears a function as a driving roller and transmits driving force of a drive motor to the transfer belt 51 by being connected with a drive motor via an unillustrated connection gear. For example, the transfer belt 51 is driven with conveyance speed (run) of 200-600 mm/sec. In order to increase a friction coefficient to the surface of the separation roller 52, rubber coating is performed onto the surface of the separation roller 52.

Transfer belt 51 is structured by, for example, resin materials, such as, polyimide (PI), poly vinylidene fluoride (PVDF) and an ethylenic copolymer (ETFE), rubber materials, such as polyurethane rubber into which conductive fillers, such as, carbon has been distributed for resistance adjustment, or a material which contains an ionicity-electric-conduction material.

A transfer power supply CH which functions as an application section is connected to the transfer roller 54. When transferring a toner image on the photoreceptor 41 onto the sheet S, transfer voltage having an opposite polarity to the toner is applied to the transfer roller 54. In an embodiment of the present invention, since the toner has a minus polarity, transfer voltage of a plus polarity is applied to the transfer roller 54, and a transfer electric field is formed.

The separation anti-static electrode 501 is an anti-static electrode which performs a corona anti-static, and is arranged in a position opposing the separation roller 52. The separation anti-static electrode 501 is a needlelike electrode (it is also called a serration electrode). For example, by performing an etching process of the SUS board of 0.1 mm thickness, the peaks which are acumination portions are arranged at a constant pitch across the passing paper sheet width direction at intervals of about 1-5 mm. Voltage, which is formed by direct-current voltage having an opposite polarity to a bias roller or the same direct-current voltage, onto which alternating current voltage has been superimposed, is applied to the needlelike electrode. A separation anti-static electrode using electric discharge wires, such as, tungsten, may be used instead of the needlelike electrode.

In order to transfer a toner image onto a proper area (imaging area) of the sheet S, the registration roller RG synchronizes the sheet S, which advances into the transfer nip portion N1, with the toner image on photoreceptor 41. The leading edge of the sheet S is detected by the sheet detection sensor SE. Based on a detection signal of the sheet detection sensor SE, voltage applied to the transfer roller 54 is controlled by the control section 100.

[Block Diagram of Control System in Image Forming Apparatus]

Figure 3:
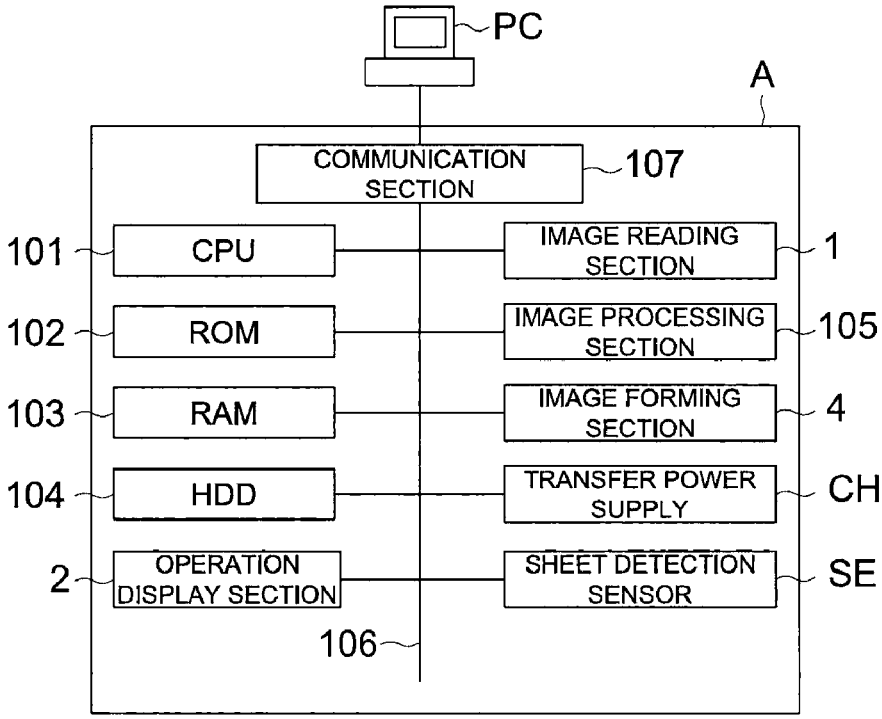
FIG. 3 illustrates a block diagram of a control system of the image forming apparatus.

FIG. 3 is a block diagram of a control system of the image forming apparatus A, and shows only a main portion of the apparatus here. CPU (Central Processing Unit) 101 is connected to ROM (Read Only Memory) 102 or RAM (Random Access Memory) 103 via system bath 106. This CPU 101 reads various programs stored in the ROM 102, expands them in the RAM 103 and controls operations of each section. The CPU 101 executes various processing according to the programs expanded in the RAM 103, stores the processing result in the RAM 103 and displays them on the operation display section 2. Then, the CPU 101 stores the processing result stored in the RAM 103 to a predetermined storage place. In an embodiment of the present invention, the control section 100 is configured so that the CPU 101 collaborates with the ROM 102 and the RAM 103.

The ROM 102 memorizes programs and data in advance and typically comprises a semiconductor memory.

The RAM 103 forms the work area which temporarily memorizes data which were processed by various programs executed by the CPU 101.

A HDD 104 has a function to memorize image data of a document image read and obtained by the image reading section 1, or to memorize outputted image data. The HDD 104 has a structure having an overlapped metal disc disk onto which magnetic particles have been coated or vapor-deposited. The metal disc is rotated at a high speed by a motor, and a magnetic head is closely brought to the metal disc to read and write data onto or from the metal disc.

The operation display section 2 enables various kinds of setups. The operation display section 2 acts as, for example, a touch-panel system. When a user inputs an instruction through the operation display section 2, conditions with respect to the image formation are set up. Various kinds of information, including information on a network setup is displayed on the operation display section 2.

The image reading section 1 optically reads a document image, and converts it into an electric signal. Image processing of image data generated by the image reading section 1 and the image data which has been transmitted from PC connected to the image forming apparatus A and received by a communication section 107 are processed by the image processing section 105.

The Image forming section 4 receives image data onto which image processing has bee performed by the image processing section 105 and forms an image on a sheet.

A transfer power supply CH is controlled by the control section 100 configured by CPU 101, and the polarity of the transfer voltage is changed based on the detection signal of the sheet detection sensor SE. The transfer device in an embodiment of the present invention is configured at least by the transfer section 5, the transfer power supply CH and the control section 100.

[Control of Transfer Power Supply]

As explained in FIG. 2, the transfer power supply CH is connected to the transfer roller 54, and a certain voltage is applied to the transfer roller 54. In order not to wind the sheet S around the photoreceptor 41 although a burr have been generated at the leading edge of the conveyance direction of the sheet S which advances into transfer nip portion N1 to prevent poor separation, and in order to fully secure the density of the toner image transferred onto the sheet S, voltage applied to the transfer roller 54 from the transfer power supply CH is adjusted. This adjustment operation will be explained in detail using FIGS. 4 and S.

Figure 4:
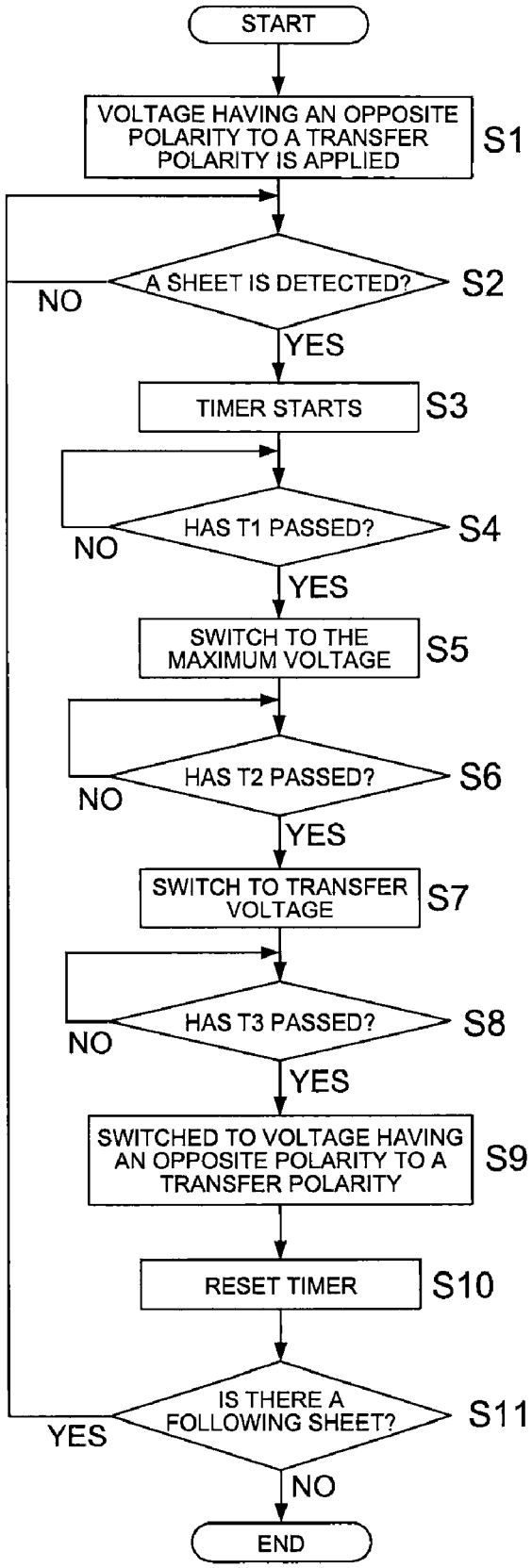
FIG. 4 illustrates a flow chart with respect to an adjustment operation of the voltage applied to a transfer roller from a transfer power supply.
Figure 5A:
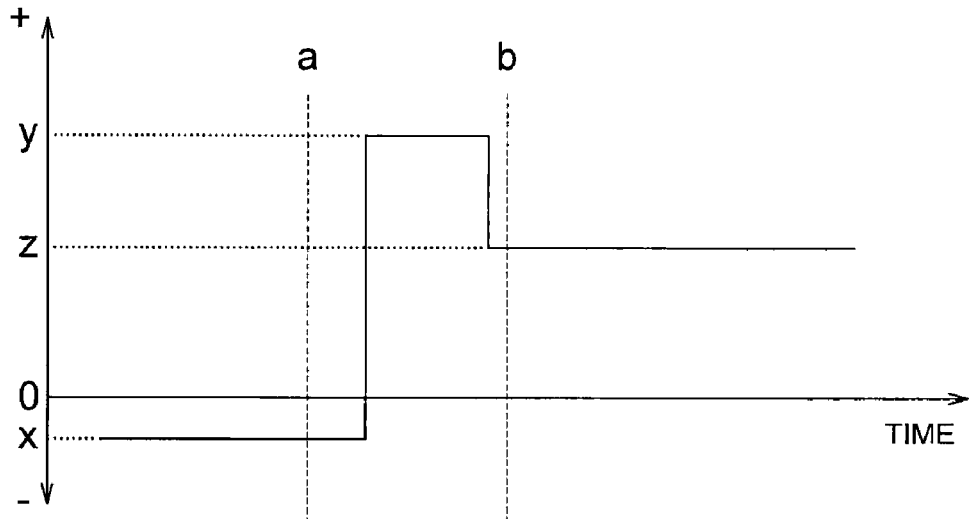
FIGS. 5*a* and 5*b* illustrate time charts at the time of executing the adjustment operation illustrated in FIG. 4.
Figure 5B:
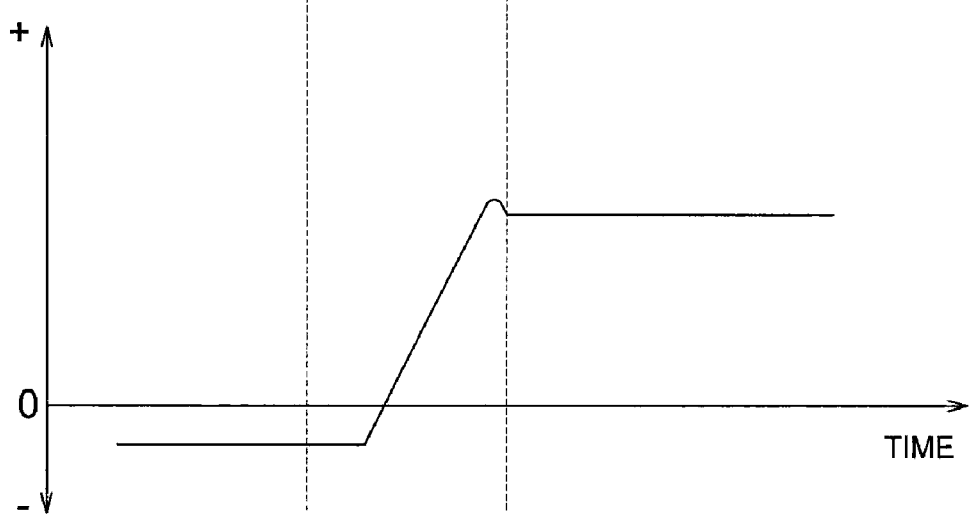
Figure 6:
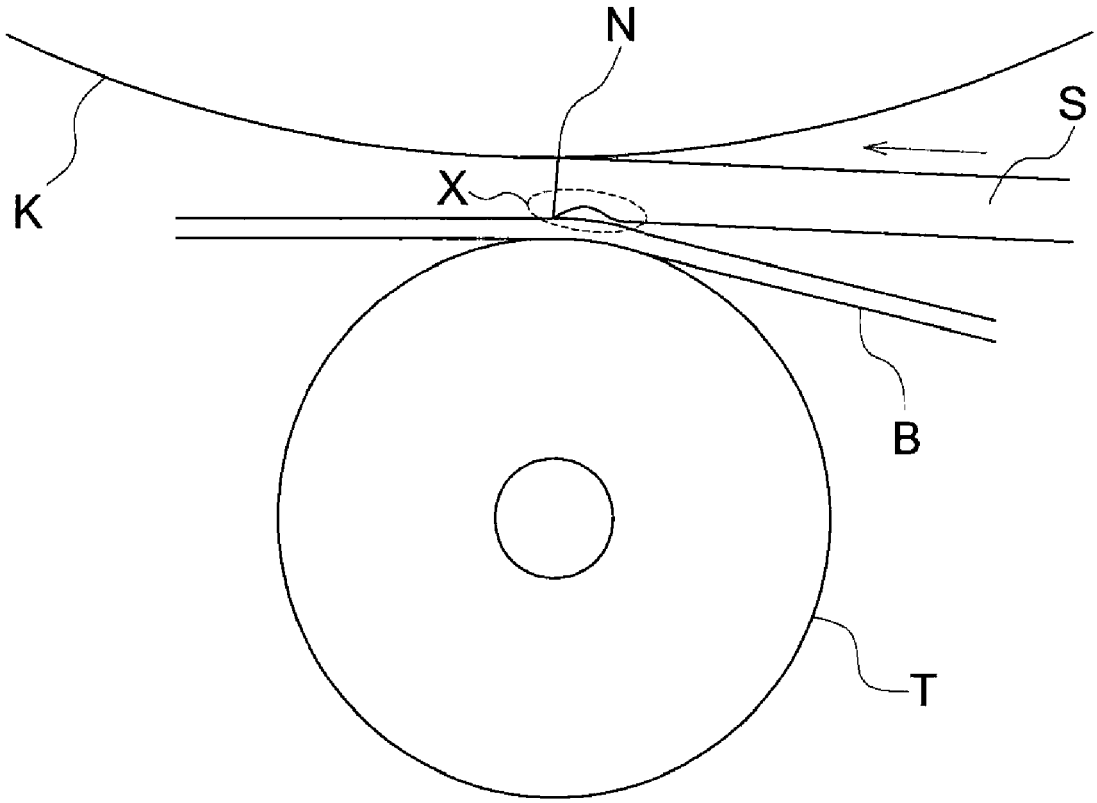
FIG. 6 illustrates an explanatory view showing a transfer area of a contact transfer system.

FIG. 4 is a flow chart drawing with respect to the adjustment operation of the voltage applied to the transfer roller 54 from the transfer power supply CH, and FIGS. 5*a* and 5*b* are time chart drawings at the time of executing the adjustment operation shown in FIG. 4. FIG. 5*a* is a time chart drawing of the voltage applied to the transfer roller 54, and FIG. 5*b* is a time chart drawing of an electric field which is generated between the transfer roller 54 and the photoreceptor 41. "a" in FIGS. 5*a* and 5*b* show a time when the conveyance direction leading edge of the sheet S has advanced into the transfer nip portion N1, and "b" in FIGS. 5*a* and 5*b* show a time when an imaging area on the sheet S has advanced into the transfer nip portion N1. Therefore, the time before "a" in FIGS. 5*a* and 5*b* is the time when the sheet S is not placed between the transfer nip portions N1. The time between "a" and "b" is the time when the non image area in the sheet S has passed the transfer nip portion N1. The time after "b" is the time when an imaging area on the sheet S has passed through the transfer nip portion N1.

Firstly, the adjustment operation of the voltage applied to the transfer roller 54 will be explained based on FIG. 4. When a job with respect to the image formation starts in the image forming apparatus A, before the sheet S advances into the transfer nip portion N1, the photoreceptor 41 and the transfer belt 51 will contact and rotate. In this case, in order to prevent the toner which remains on the non image area of the photoreceptor 41 from being transferred to the transfer belt 51, the control section 100 controls the transfer power supply CH, and applies voltage having a transfer polarity (an embodiment of the present invention plus polarity) which is opposite (an embodiment of the present invention: minus polarity) to the transfer roller 54 (STEP S1). When showing the state of STEP S1 in FIG. 5*a*, before the sheet S advances into the transfer nip portion N1 (time before "a" in FIGS. 5*a* and 5*b*), voltage x which is a minus polarity will be applied to the transfer roller 54.

Thus, by applying voltage having a polarity which is opposite to the transfer polarity, i.e., the same polarity as the toner to the transfer roller 54, the toner of the photoreceptor 41 is not transferred onto the transfer belt 51, and the transfer belt 51 does not become dirty. Particularly, in case of forming a patch image for image adjustment in a non image area of the photoreceptor 41, it is effective in order not to transfer the patch image onto the transfer belt 51.

As shown in FIG. 5*a*, when the voltage having the polarity which is an opposite polarity to the transfer polarity is applied to the transfer roller 54 at STEP S1 shown in FIG. 4, the voltage having the polarity which is opposite to the transfer polarity is applied to the transfer roller 54 until a predetermined non image area in the sheet S has passes through the transfer nip portion N1 (time to switch to the maximum voltage y from a voltage x in FIGS. 5*a* and 5*b*), after the conveyance direction leading edge of the sheet S advances into the transfer nip portion N (time of "a" of FIGS. 5*a* and 5*b*).

Thus, when voltage having the polarity which is opposite to the transfer polarity is applied to the transfer roller 54 and the direction of the electric field is arranged to be heading to the direction of the transfer roller 54 from the photoreceptor 41 in the conveyance direction leading edge of sheet S, even if there is a burr at the conveyance direction leading edge of the sheet S and electric discharge occurs in an opening between the transfer belt 51 and the sheet S, the conveyance direction leading edge of sheet S is charged in the same polarity as the photoreceptor 41. As a result, the leading edge of the sheet S repulses the photoreceptor 41, the leading edge of the sheet S departs from the photoreceptor 41 and poor separation that the sheet S winds around the photoreceptor 41 ceases to occur.

Next, an operation switched to the voltage in the transfer polarity side after applying the voltage having a polarity which is an opposite polarity to the transfer polarity will be explained.

As shown in FIG. 5*a*, the voltage having a polarity which is an opposite polarity to the transfer polarity is applied to the transfer roller 54 after the conveyance direction leading edge of the sheet S advances into the transfer nip portion N1 until a predetermined non image area passes through the transfer nip portion N1, as shown in FIG. 5*a*. However, proper transfer is not performed unless a proper transfer electric field is formed when an imaging area of the sheet S advance into transfer nip portion N1. Therefore, the density of a toner image to be transferred onto the sheet S cannot be fully secured. Then, in order to immediately form a proper transfer electric field, it is designed that the voltage is switched from the voltage having a polarity which is an opposite polarity to the transfer polarity to the voltage having a polarity which is in the transfer polarity side.

The above process will be explained below using FIG. 4.

The sheet detection sensor SE in an upstream side of the transfer nip portion N1 detects the sheet (refer to FIG. 2) S. When the sheet S is detected by the sheet detection sensor SE (STEP S2; Yes), a timer installed in the image forming apparatus A will be started (STEP S3). A time is measured after starting a timer until T1 (time) passes. T1 is the time for switching to voltage in the transfer polarity side from the voltage having a polarity which is opposite to the transfer polarity, and a value of T1 determined in advance is memorized in ROM 102. When it is determined that T1 has passed at STEP S3, it will be switched to the maximum voltage y which is the voltage in the transfer polarity side (STEP S5).

As shown in FIG. 5*a*, the timing switched to the maximum voltage y from the voltage x is in between "a" and "b" of FIGS. 5*a* and 5*b*. That is, the timing is the time within which the non image area in the sheet S passes through the transfer nip portion N1. The voltage is switched at such time because a proper transfer electric field needs to be formed when the imaging area in the sheet S advances into the transfer nip portion N1.

Even though voltage is switched at such time, since voltage x of a minus polarity is applied to the transfer roller 54 after the conveyance direction leading edge of the sheet S advances into the transfer nip portion N1 until a predetermined non image area passes through the transfer nip portion N1, poor separation of sheet S is not generated.

Since an absolute value of the maximum voltage y switched from the voltage x of minus polarity is larger than an absolute value of the transfer voltage z applied to the transfer roller 54 when transferring a toner image of photoreceptor 41 onto the sheet S, as shown in FIG. 5*b*, it can be immediately returned to a proper transfer electric field.

After switching to the maximum voltage y at STEP S5, it is measured whether T2 (time) has passed by the timer installed in the image forming apparatus A (STEP S6). When it is determined that T2 has passed at STEP S6, the voltage will be switched to the transfer voltage z from the maximum voltage y (STEP S7).

As shown in FIG. 5*a*, the voltage is switched to the transfer voltage z before "b" which is a time of an imaging area in the sheet S advancing into the transfer nip portion N1. Based on this process, as shown in FIG. 5*b*, when the imaging area in the sheet S advances into the transfer nip portion N1, a proper transfer electric field can be formed, and the density of a toner image transferred onto the sheet S can fully be secured.

In order to apply the voltage x having a polarity which is opposite to the transfer polarity after finishing the transfer to the sheet S again after switching to the transfer voltage z at STEP S7, whether T3 (time) has passed is measured by the timer installed in the image forming apparatus A (STEP S8). When it is determined that T3 has passed at STEP S8, the voltage will be switched to voltage x having a polarity which is opposite to the transfer polarity from the transfer voltage z (STEP S9), and the timer will be reset (STEP S10). Thus, if voltage x having a polarity which is opposite to the transfer polarity is set, the toner of the photoreceptor 41 will not be transferred to the transfer belt 51, and the transfer belt 51 will not become dirty.

As long as there is a following sheet in a job with respect to image formation, operations of STEPs S2-S10 will be executed.

Voltage having a polarity which is opposite to the transfer polarity is applied to the transfer roller 54 until a predetermined non image area in the sheet S passes through the transfer nip portion N2 after the conveyance direction leading edge of the sheet S advances into the transfer nip portion N1 as explained using FIGS. 4, 5*a* and 5*b* above. Then, while the non image area in the sheet S passes the transfer nip portion N2, the voltage is switched to the voltage (the maximum voltage y) in the transfer polarity side from the voltage of the opposite polarity, and it is applied to the transfer roller 54. Thereby, poor separation of sheet S can be prevented and a density of a toner image which is transferred onto the sheet S is fully secured.

Particularly as for the photoreceptor 41 of a drum shape as shown in FIGS. 1 and 2, the diameter tends to become larger to improve the speed of the apparatus and to improve durability. Therefore it is difficult to separate a sheet using curvature as compared with a belt-shaped image carrying member which can freely set up the curvature in the transfer section. Then, it is effective to apply the present invention in a transfer device and an image forming apparatus which have drum-shaped image carrying members (a photoreceptor drum, a transfer drum, etc.).

The present invention is not limited to the embodiment, and although there are changes and an additions in the scope of the present invention which does not depart from the gist of the present invention, it will be contained in the present invention.

The determination whether the adjustment operation in FIG. 4 may be executed according to the type of a sheet S. For example, in case of the type of a sheet S with which poor separation tends to occur, the adjustment operation shown in FIG. 4 may be executed. And the adjustment operation shown in FIG. 4 may not be executed in the case of a thick paper sheet or a coated paper with which poor separation do not easily occur.

Whether the adjustment operation in FIG. 4 is executed may be determined according to the image information to be formed on the sheet S. For example, since poor separation is hard to occur although the sheet S has a burr in case of forming an image to an area at the leading edge in the conveyance direction of the sheet S, the adjustment operation in FIG. 4 may not be executed.

It may be determined whether adjustment operation in FIG. 4 is executed by detecting a burr and the direction of a burr in a sheet.

According to a transfer device and an image forming apparatus related to an embodiment of the present invention, poor separation of a sheet can be prevented and density of a toner image to be transferred onto a sheet is fully securable.

What is claimed is:

1. A transfer device for use with a sheet, the transfer device comprising:

a transfer section for transferring a toner image on an image carrier onto the sheet passing through a nip portion which is formed between the transfer section and the image carrier;

an application section for applying a voltage to the transfer section; and a control section for controlling the application section, wherein the control section controls the application section to apply a voltage having polarity opposite to a transfer polarity to the transfer section when a leading edge of the sheet in a conveyance direction advances into the nip portion until a predetermined non image area of the sheet has passed through the nip portion, and apply a voltage having the transfer polarity to the transfer section after the predetermined non image area of the sheet has passed through the nip portion and while a non image area of the sheet passes through the nip portion;

wherein the transfer polarity is opposite to a polarity of the toner image.

2. The transfer device described in claim 1, wherein the control section controls the application section so that an absolute value of the voltage having the transfer polarity applied to the transfer section after the predetermined non image area of the sheet has passed through the nip portion and while non image area of the sheet passes through the nip portion is larger than an absolute value of a voltage applied to the transfer section when the toner image on the image carrier is transferred onto the sheet.

3. The transfer device described in claim 2, wherein the control section further controls the application section to switch to apply the voltage applied to the transfer section when the toner image on the image carrier is transferred onto the sheet, from the voltage having the transfer polarity applied to the transfer section after the predetermined non image area of the sheet has passed through the nip portion, while the non image area of the sheet passes through the nip portion.

4. The transfer device described in claim 3, wherein the control section further controls the application section to apply the voltage having the opposite polarity to the transfer polarity to the transfer section after having completed transferring the toner image on the image carrier onto the sheet.

5. The transfer device described in claim 1, wherein the control section further switches the control of the application section according to a type of the sheet.

6. The transfer device described in claim 5, wherein the control section disables the control of the application section to apply the voltage having the opposite polarity to the transfer polarity to the transfer section after the leading edge of the sheet in the conveyance direction advances into the nip portion until the predetermined non image area of the sheet have passed through the nip portion, in case when the sheet is a sheet thicker than a predetermined thickness or the sheet is a coated paper.

7. The transfer device described in claim 1, wherein the control section switches the control of the application section according to image information to be formed on the sheet.

8. The transfer device described in claim 7, wherein the control section does not execute the control of the application section to apply the voltage having the opposite polarity to the transfer polarity to the transfer section after a leading edge of the sheet in a conveyance direction advances into the nip portion until the predetermined non image area of the sheet have passed through the nip portion, in case when the image is formed up to an area of the leading edge of the sheet in the conveyance direction.

9. An image forming apparatus comprising:

an image forming device which visualizes an electrostatic latent image on the image carrier by developing agent;

the transfer device described in claim 1; and a fixing device which fixes the toner image transferred by the transfer device onto the sheet.

10. A control method of a transfer device which comprises a transfer section for transferring a toner image on an image carrier onto a sheet passing through a nip portion which is formed between the transfer section and the image carrier and an application section for applying voltage to the transfer section, the control method comprising:

controlling the application section to apply a voltage having an opposite polarity to a transfer polarity to the transfer section when a leading edge of the sheet in a conveyance direction advances into the nip portion until a predetermined non image area of the sheet has passed through the nip portion; and controlling the application section to apply a voltage having the transfer polarity to the transfer section after the predetermined non image area of the sheet has passed through the nip portion and while a non image area of the sheet passes through the nip portion;

wherein the transfer polarity is opposite to a polarity of the toner image.

11. The control method described in claim 10, wherein an absolute value of the voltage having the transfer polarity applied to the transfer section after the predetermined non image area of the sheet has passed through the nip portion and while a non image area of the sheet passes through the nip portion is larger than an absolute value of a voltage applied to the transfer section when the toner image on the image carrier is transferred onto the sheet.

12. The control method described in claim 11 further comprising controlling the application section to switch to apply a voltage applied when the toner image on the image carrier is transferred onto the sheet to the transfer section from the voltage having the transfer polarity applied to the transfer section after the predetermined non image area of the sheet has passed through the nip portion, while the non image area of the sheet passes through the nip portion.

13. The control method described in claim 12, further comprising controlling the application section to apply the voltage having the opposite polarity to the transfer polarity after having completed transferring the toner image on the image carrier onto the sheet.

14. The control method described in claim 10, further comprising switching the controlling of the application section according to a type of the sheet.

15. The control method described in claim 14, further comprising disabling the controlling the application section to apply the voltage having the opposite polarity to the transfer polarity to the transfer section after the leading edge of the sheet in the conveyance direction advances into the nip portion until the predetermined non image area of the sheet has passed through the nip portion, in case when the sheet is a sheet thicker than a predetermined thickness or the sheet is a coated paper.

16. The control method described in claim 10 further comprising switching the controlling of the application section by image information to be formed on the sheet.

17. The control method described in claim 16, further comprising disabling the controlling the application section to apply the voltage having the opposite polarity to the transfer polarity to the transfer section after a leading edge of the sheet in the conveyance direction advances into the nip portion until the predetermined non image area of the sheet has passed through the nip portion, in case when the image is formed up to an area of the leading edge of the sheet in a conveyance direction.

18. The control method described in claim 10, wherein the transfer device is provided in an image forming apparatus comprising:

an image forming device which visualizes an electrostatic latent image on an image carrier by developing agent; and a fixing device which fixes the toner image transferred by the transfer device onto the sheet.

* * * * *